US010371384B2

(12) United States Patent
Mery et al.

(10) Patent No.: US 10,371,384 B2
(45) Date of Patent: Aug. 6, 2019

(54) FUEL INJECTION SYSTEM FOR AIRCRAFT TURBOMACHINE, COMPRISING A VARIABLE SECTION AIR THROUGH DUCT

(71) Applicant: SAFRAN AIRCRAFT ENGINES, Paris (FR)

(72) Inventors: Yoann Mery, Paris (FR); Olivier Baptiste Bidart, Paris (FR); Julien Leparoux, Alfortville (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 53 days.

(21) Appl. No.: 15/542,860

(22) PCT Filed: Jan. 20, 2016

(86) PCT No.: PCT/FR2016/050107

§ 371 (c)(1),
(2) Date: Jul. 11, 2017

(87) PCT Pub. No.: WO2016/116700

PCT Pub. Date: Jul. 28, 2016

(65) Prior Publication Data

US 2018/0010799 A1 Jan. 11, 2018

(30) Foreign Application Priority Data

Jan. 20, 2015 (FR) ..... 15 50444

(51) Int. Cl.
*F23R 3/22* (2006.01)
*F23R 3/14* (2006.01)
(Continued)

(52) U.S. Cl.
CPC ..... *F23R 3/14* (2013.01); *F23N 1/025* (2013.01); *F23N 1/027* (2013.01); *F23R 3/28* (2013.01);
(Continued)

(58) Field of Classification Search
CPC ..... F23R 3/12; F23R 3/14; F23R 3/32; F23R 3/30; F23R 3/38; F23R 3/20; F23R 3/22; F23R 3/26; F23R 3/283
See application file for complete search history.

(56) References Cited

U.S. PATENT DOCUMENTS 2,930,191 A * 3/1960 Schirmer ..... F23R 3/26 60/738
3,490,230 A * 1/1970 Suter ..... F23R 3/26 431/352
(Continued)

FOREIGN PATENT DOCUMENTS

FR 2 406 726 A1 5/1979
FR 2 685 452 B1 2/1994
(Continued)

OTHER PUBLICATIONS

International Search Report dated Apr. 6, 2016 in PCT/FR2016/050107 filed Jan. 20, 2016.
(Continued)

*Primary Examiner* — William H Rodriguez
*Assistant Examiner* — Thomas P Burke
(74) *Attorney, Agent, or Firm* — Oblon, McClelland, Maier & Neustadt, L.L.P.

(57) ABSTRACT

An assembly includes an injection system and an injector for an aircraft turbomachine combustion chamber. The system includes an aerodynamic bowl including a first end widening toward the downstream end and centered on a central axis of the injection system, this also including a central body along which a film of fuel is intended to flow in the downstream direction. The central body includes a second end widening toward the downstream end, the first and second widening ends between them delimiting an air through duct and the system includes motion inducing a device allowing a relative movement between the first widening end which is
(Continued)

stationary and the second widening end, along the central axis of the injection system, by moving the central body relative to the injector.

7 Claims, 4 Drawing Sheets

(51) Int. Cl.
*F23N 1/02* (2006.01)
*F23R 3/30* (2006.01)
*F23R 3/28* (2006.01)

(52) U.S. Cl.
CPC ..... *F23R 3/30* (2013.01); *F23D 2900/11101* (2013.01)

(56) References Cited

U.S. PATENT DOCUMENTS 4,150,539 A * 4/1979 Rubins ..... F23R 3/34 60/39.23
4,271,675 A 6/1981 Jones et al.
4,679,512 A 7/1987 Skoog
5,217,363 A 6/1993 Brais et al.
5,235,813 A * 8/1993 McVey ..... F23R 3/12 431/181
6,199,367 B1 * 3/2001 Howell ..... F23D 11/24 239/402.5
2010/0031669 A1 * 2/2010 Ensign ..... F02C 3/10 60/784

FOREIGN PATENT DOCUMENTS

FR 2 832 493 B1 7/2004
FR 2 875 585 A1 3/2006

OTHER PUBLICATIONS

French Search Report dated Dec. 8, 2015 in FR 1550444 filed Jan. 20, 2015.
U.S. Appl. No. 15/216,029, filed Jul. 21, 2016, U.S. 2017/0023251 A1, Julien Leparoux et al.
U.S. Appl. No. 15/026,010, filed Mar. 30, 2016, U.S. 2016/0237896 A1, Francois Leglaye et al.
U.S. Appl. No. 15/529,570, filed May 25, 2017, Yoann Mery et al.

* cited by examiner

FUEL INJECTION SYSTEM FOR AIRCRAFT TURBOMACHINE, COMPRISING A VARIABLE SECTION AIR THROUGH DUCT

FIELD OF THE INVENTION

The present invention relates to the field of combustion chambers for aircraft turbomachines, preferably for turbojets.

It relates more specifically to injection systems fitted in the combustion chamber, these injection systems having the primary function of mixing air with the fuel supplied by the injectors.

STATE OF THE RELATED ART

Injection systems are the subject of numerous developments. The design thereof is continuously optimised so as to enhance the performances thereof in respect of ignition on the ground, altitude relighting, or flameout. It is also sought to limit as much as possible pollution when idling, which is closely linked with the ability of the injection system to atomise and mix the injected fuel with air. Such aerodynamic injection systems are known from the documents FR 2 875 585, or from the documents FR 2 685 452 and FR 2 832 493.

Nevertheless, obtaining optimal performances for certain operating points of the turbomachine, involves design constraints which may prove to be unsuitable for other operating points, wherein the overall performances are then reduced. Indeed, the design constraints for operation at full throttle and at cruising speed may differ significantly from those for low-speed operation. For example, a significant air pressure drop via the injection system is advantageous for atomising and mixing the fuel when idling, so as to increase the stability of the flame. However, this pressure drop becomes penalising in terms of specific consumption in full throttle and cruising mode.

DISCLOSURE OF THE INVENTION

The aim of the invention is thus that of remedying at least partially the drawbacks in relation to the embodiments of the prior art.

For this purpose, the invention relates to an assembly comprising an injection system for an aircraft turbomachine combustion chamber, as well as a fuel injector engaging with the injection system.

The invention is firstly characterised in that it makes it possible to vary the length of the film of fuel lining the central body of the injection system, according to the outlet range of this injection system in the aerodynamic bowl. This ability to vary the length of the film of fuel advantageously influences the stability of the flame, which may thus be satisfactory for all engine speeds.

Furthermore, the invention introduces an additional degree of freedom in the design of the injection system, by making it possible to vary the cross-section of the air through duct defined between the first and second coaxial widening ends. Due to this specific feature, the geometry of the injection system may be adapted according to the operating points of the turbomachine, which also helps obtain increased performances for all engine speeds. In particular, being able to vary the cross-section of the air through duct makes it possible to influence the richness of the air-fuel mixture, which has a direct impact on the stability of this mixture. Moreover, this ability to vary the cross-section of the air through duct makes it possible to influence fuel atomisation, which takes place at the outlet of the second widening end of the central body. Advantageously, the atomisation phenomenon has a direct impact on the stability of the combustion chamber, on the capability in respect of ignition on the ground and altitude relighting, or on pollutant emissions in idling mode. All of these parameters may thereby be optimised for all the operating points of the turbomachine, due to the degree of freedom of movement introduced into the design of the injection system according to the invention.

The invention preferably has at least one of the following optional features, taken alone or in combination.

Said first and second widening ends are tapered in shape and define therebetween a tapered air through duct, having a variable cross-section according to a relative axial position between said first and second widening ends. Nevertheless, further non-tapered widening shapes may be selected, without leaving the scope of the invention.

The injection system comprises an intermediate structure arranged radially between a base of the central body and a base of the aerodynamic bowl, said intermediate structure defining with the base of the central body an axial duct for the flow of the film of fuel in the direction of said second widening end of the central body.

The base of the aerodynamic bowl comprises two concentric walls between which an air admission twist is arranged between the two concentric walls.

Said motion-inducing means comprise a motor, for example a linear motor.

Said first widening end of the aerodynamic bowl is perforated with air admission holes in a combustion area defined by this bowl.

The invention also relates to an aircraft turbomachine combustion chamber comprising a combustion chamber bottom perforated with openings spaced apart from one another, the combustion chamber comprising, associated with each opening of the chamber bottom, an assembly as described above.

Finally, the invention relates to an aircraft turbomachine comprising such a combustion chamber.

Further advantages and features of the invention will emerge in the non-restrictive detailed description hereinafter.

BRIEF DESCRIPTION OF THE DRAWINGS

The invention will be understood more clearly on reading the detailed description hereinafter, non-restrictive examples of embodiments thereof, and on studying the appended figures wherein.

DETAILED DESCRIPTION OF PREFERRED EMBODIMENTS

Figure 1:
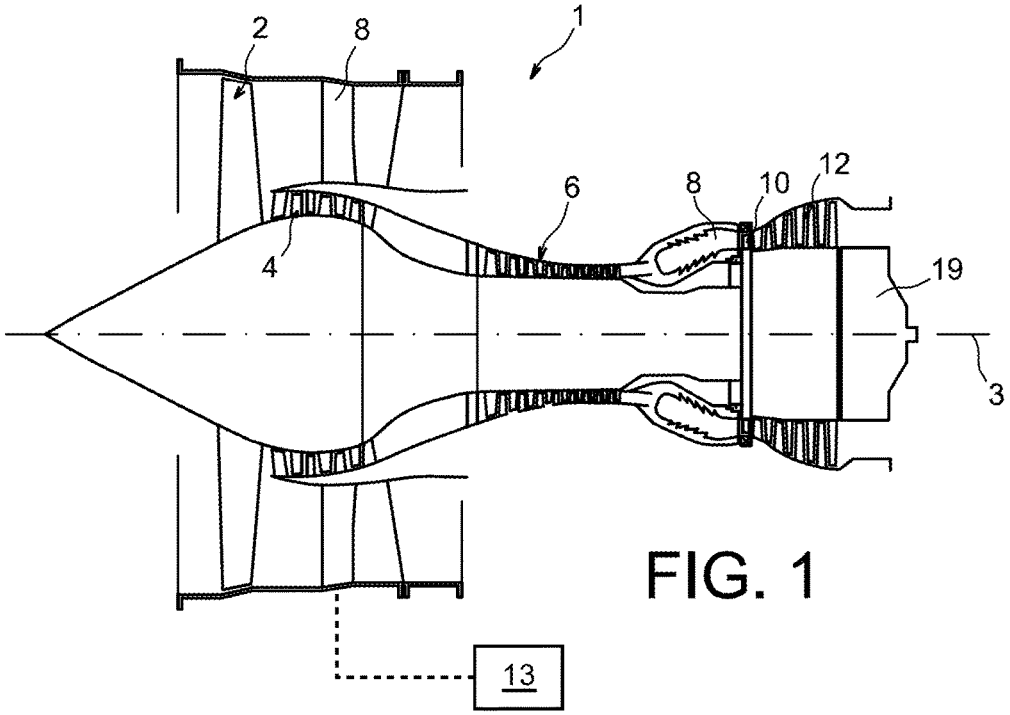
FIG. 1 represents a schematic longitudinal section view of a turbojet according to the invention.

With reference firstly to FIG. 1, an aircraft turbomachine 1, according to a preferred embodiment of the invention, is represented. It consists herein of a dual-flow or dual-body turbojet. Nevertheless, it could consist of a turbomachine of another type, for example a turboprop, without leaving the scope of the invention.

The turbomachine 1 has a longitudinal axis 3 about which the various components thereof extend. It comprises, from upstream to downstream along a main gas flow direction through this turbomachine, a fan 2, a low-pressure compressor 4, a high-pressure compressor 6, a combustion chamber 8, a high-pressure turbine 10 and a low-pressure turbine 12. Conventionally, this turbomachine 1 is controlled by a control unit 13, only represented schematically. This unit 13 is particularly suitable for controlling the various operation points of the turbomachine.

Figure 2:
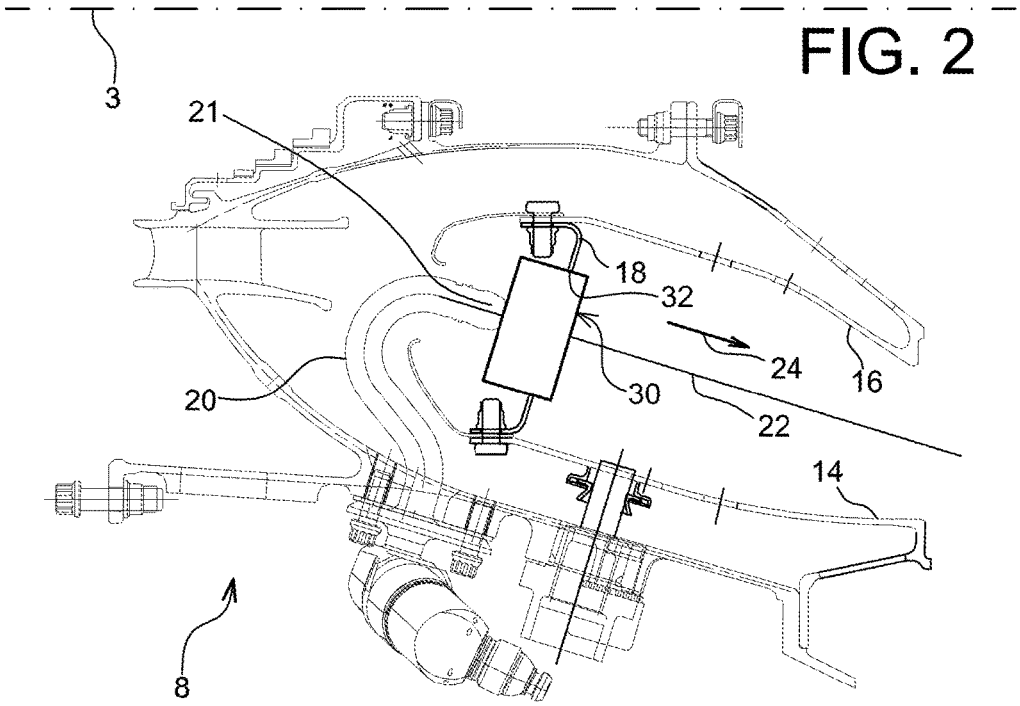
FIG. 2 represents a half-longitudinal section view of the combustion chamber of the turbojet shown in the previous figure.

A portion of the combustion chamber 8 is reproduced in more detail in FIG. 2. It particularly shows an outer ferrule 14 centred on the axis 3, an inner ferrule 16 also centred on the same axis, and a chamber bottom 18 connecting the two ferrules at the upstream end thereof. Fuel injectors 20 are regularly distributed on the chamber bottom, along the circumferential direction (a single injector being visible in FIG. 2). Each has an injector nozzle 21, oriented along a main axis 22 inclined slightly with respect to the axis 3. In this regard, it is indicated that this axis 22 is parallel with the main flow direction of the flow 24 through the chamber.

With each injector 20 is associated an injection system 30, represented schematically in FIG. 2. The injection system 30 engages upstream with the injector nozzle 21, whereas it leads downstream to the combustion chamber 8. The injection system 30 is housed in an opening 32 formed through the chamber bottom 18. As such, in this chamber, a plurality of openings 32 spaced apart circumferentially with respect to one another, and each associated with an injection system 30 wherein the central axis corresponds to the axis 22, are provided.

Figure 3A:
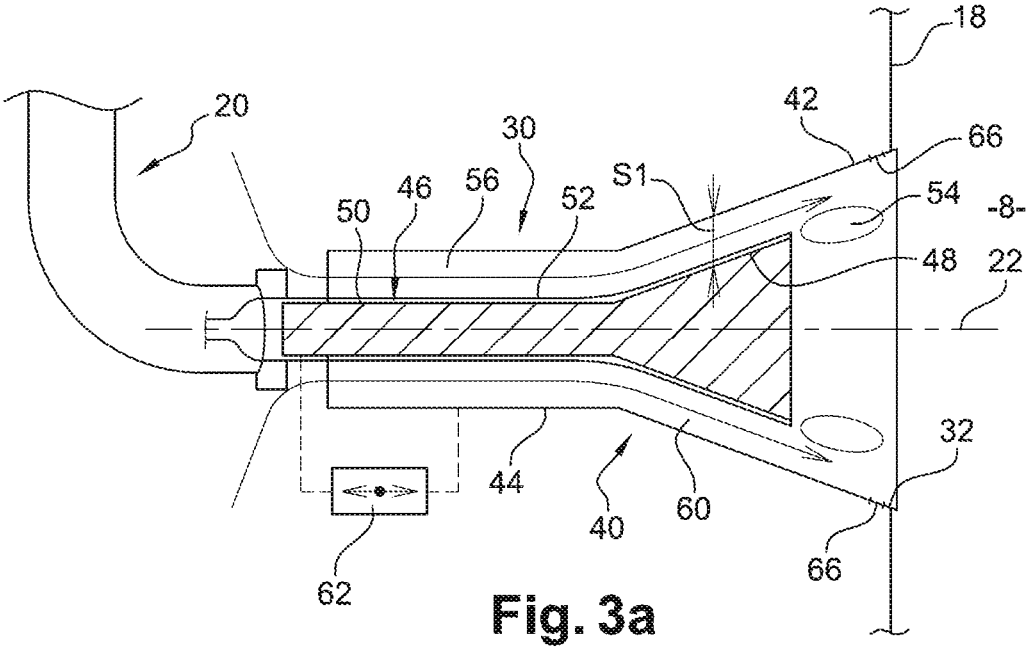
FIGS. 3*a* and 3*b* represent schematic views of an injection system fitted in the combustion chamber shown in the previous figure, in two separate positions of the central body of this injection system respectively.
Figure 3B:
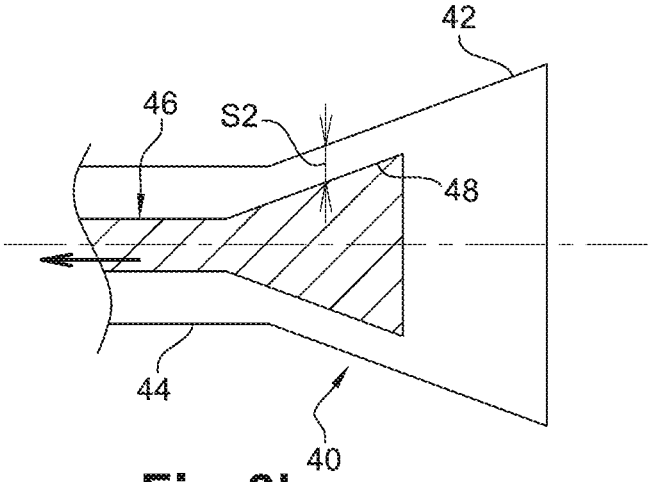

FIGS. 3*a* and 3*b* show the principle of the injection system 30 according to the invention. This system 30, of the aerodynamic injection system type, comprises firstly an outer wall formed by an aerodynamic bowl 40, equipped with a first end widening towards the downstream end 42, or divergent part. This widening end 42 is tapered in shape, having an axis 22. Downstream, the bowl comprises a base 44 also centred on the axis 22. Furthermore, the system 30 comprises a solid central body 46 at least housed in part inside the space defined by the bowl 40. The body 46 is equipped with a second end widening towards the downstream end 48, or divergent part. This widening end 48 is tapered in shape, having an axis 22. Downstream, the body comprises a base 50 also centred on the axis 22, and arranged inside the aforementioned base 44.

In a known manner, the injector 20 engages with the injection system 30 such that a film of fuel travels along the central body 46, towards the downstream end. The film of fuel 52 thereby flows towards the downstream end on the outer surface of the base 50 and the widening end 48 of the central body 46. At the outlet of this body, due to the divergent shape, the film 52 is atomised which enables it to catch the flame 54 situated inside the chamber. Furthermore, the recirculation formed at the end of this divergent part 48 makes it possible to stabilise the flame and thereby increase flameout performances. Furthermore, the widening end 42 comprises an annular row of holes 66 for admitting air into the combustion area. These holes are situated in the vicinity of an attachment flange (not shown) used to attach the bowl onto the chamber bottom 18, in the associated opening 32.

The selected design therefore implements a flow of a film of fuel 52 along the central body 46 of the injection system, such as that for example of the prior art. This fuel film injection design differs from the so-called "spray" design wherein the fuel is injected via a twist, also enabling air flow. Due to the flow of the fuel in the twist, in spray form, the permeability of the injection system to air is modified thereby. On the other hand, in the invention, the air is intended to flow through the injection system 30 via an air through duct 56 defined between the bowl 40 and the central body 46. This flow, initiated preferably by a twist (not shown in FIGS. 3*a* and 3*b*), is not disrupted by the film of fuel 48 flowing merely on the inner wall of this duct 56.

In particular, at the widening ends 42, 48, a tapered air through duct 60 is defined, forming the downstream part of the aforementioned duct 56. The tapered duct 60 is centred on the axis 22 and has a cross-section referenced S1 in FIG. 3*a*. One of the specificities of the invention lies in that the injection system incorporates a degree of freedom of movement making it possible to vary the cross-section of the tapered duct 60, according to the needs encountered.

More specifically, the injection system 30 comprises motion-inducing means 62, allowing a relative movement between the first and second widening ends 42, 48, along the axis 22. These means 62 are of the conventional type, for example incorporating a linear motor, or an electromagnet. They are controlled by the unit 13, and are suitable for inducing the motion the central body 46 inside the bowl 40, the latter being stationary with respect to the chamber bottom 18 and the injector 20. In addition, according to the relative axial position between the first and second widening ends 42, 48, the cross-section of the duct 60 varies. In FIG. 3*b*, this cross-section referenced S2 is less than the cross-section S1 in FIG. 3*a*, as the central body 46 has been moved towards the upstream end by the means 62.

Being able to vary the cross-section of the duct 60 makes it possible to influence the richness of the air-fuel mixture, which has a direct impact on the stability of this mixture. This ability to vary the cross-section of the air through duct makes it possible to influence fuel atomisation, which takes place at the outlet of the second widening end of the central body. Indeed, the atomisation may be characterised by the ratio of the quantities of movements of air and fuel, and therefore directly dependent on the cross-section of the air through duct. This atomisation may also vary according to the length of the film of fuel 52 outwardly lining the central body 46, this length being greater in the position in FIG. 3*a* than in the position in FIG. 3*b* wherein the central body 46 is set back, towards the upstream end.

Advantageously, the atomisation phenomenon has a direct impact on the stability of the combustion chamber, on the capability in respect of ignition on the ground and altitude relighting, or on pollutant emissions in idling mode. All of these parameters may thereby be optimised for all the operating points of the turbomachine. For example, a significant air pressure drop via the injection system is advantageous for atomising and mixing the fuel when idling, so as to increase the stability of the flame. The position in FIG. 3*b*, with the reduced cross-section S2, shall thus be preferred for this turbomachine idling mode. On the other hand, to limit losses in terms of specific consumption, the position in FIG. 3*a* shall be preferentially adopted for full-throttle and cruising modes.

Figure 4A:
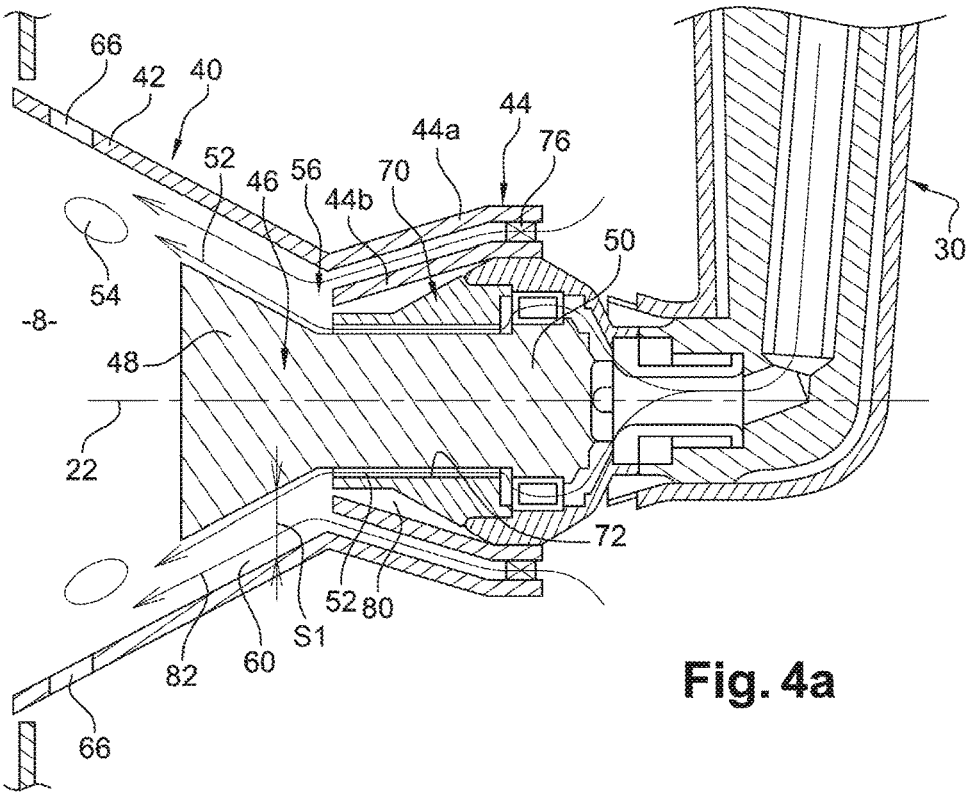
FIGS. 4*a* and 4*b* represent views of an injection system according to a preferred embodiment of the invention, in two separate positions of the central body of this injection system respectively.
Figure 4B:
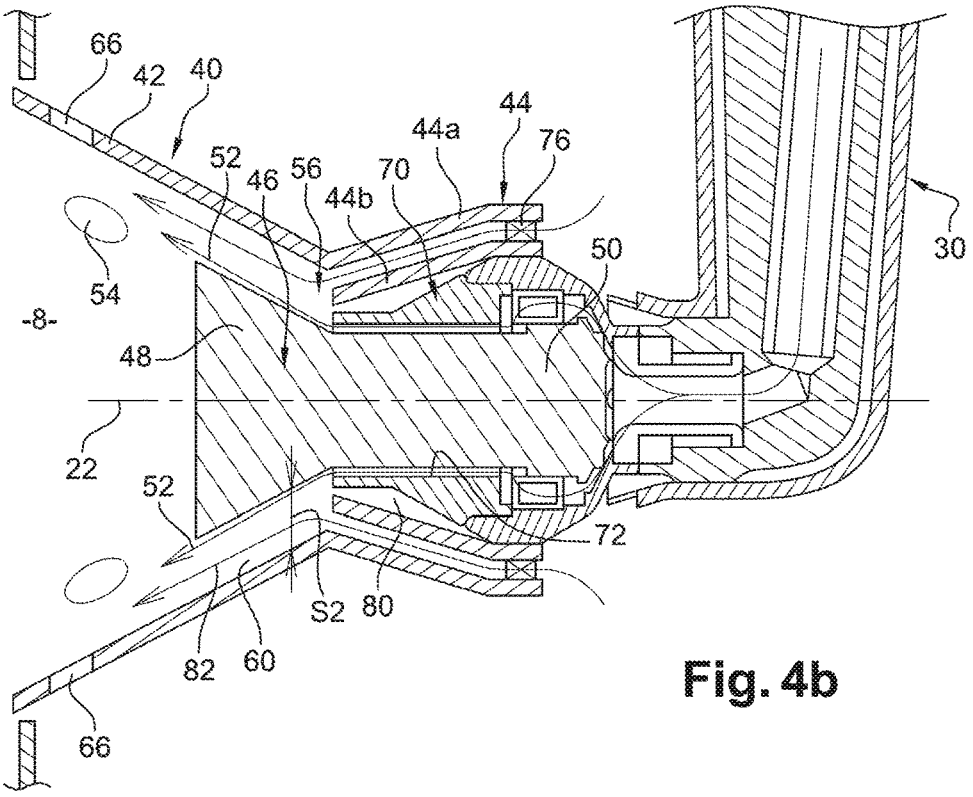

With reference now to FIGS. 4*a* and 4*b*, the injection system 30 according to a preferred embodiment of the invention has been represented. In these figures, elements bearing the same reference numbers and elements in the schematic FIGS. 3*a* and 3*b* correspond to identical or similar elements. For the purposes of clarity, the motion-inducing means 62 of the main body 46 have not been shown in these FIGS. 4*a* and 4*b*. Nevertheless, these means 62 are obviously envisaged and actuated to move the main body 46 from the position in FIG. 4*a* to that in FIG. 4*b*, and conversely.

In addition, in this preferred embodiment, the injection system 30 comprises an intermediate structure 70, arranged radially between the base 50 of the central body 46 and the base 44 of the bowl 40. It is relative to this intermediate structure 70 that the main body 46 is capable of being moved axially between the two positions in FIGS. 4*a* and 4*b*, the structure 70 remaining stationary relative to the injector 20 and the bowl 40.

The intermediate structure 70 defines with the outer surface of the base 50 an axial annular duct 72 for the flow of the film of fuel 52, towards the second widening end 48 of the central body 46. It is indeed this duct 72 which is supplied in a known manner by the injector 20 and which makes it possible to generate the thin film of fuel 52 along the central body 46, before encountering the air admitted into the injection system. In the preferred embodiment shown, the fuel bypasses the upstream end of the solid central body 46 before lining the outer wall thereof defining internally the axial annular duct 72.

The base 44 of the bowl 40 comprises herein two concentric walls 44*a*, 44*b* between which a twist 76 for the admission of air between the two concentric walls is arranged, this twist being axial or radial in nature. The air from the twist 76 and flowing between the two outer and inner walls 44*a*, 44*b*, then joins the tapered duct 60 wherein the film of fuel 52 flows along the outer surface of the tapered end 48 of the central body 46. The inner wall 44*b* surrounds the intermediate structure 70, so as to define therebetween a duct 80 leading towards the downstream end. In this preferred embodiment, the duct 80 is not intended to be traversed by an air flow.

In the duct 60 greater in width than that of the duct 72 wherein the film of fuel 52 is created, the latter remains confined along the lateral surface of the tapered end 48 of the central body 46, by means of the flow of the air 82 in said duct 60.

Figure 5:
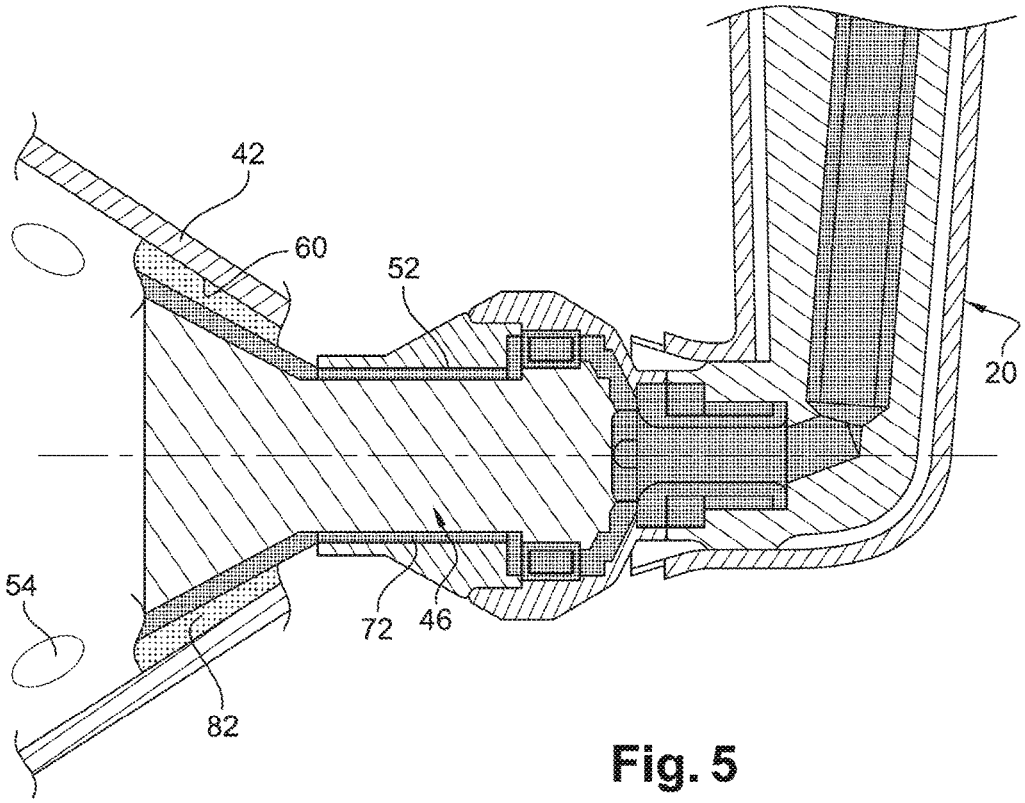
FIG. 5 represents a similar view to those of FIGS. 4*a* and 4*b*, wherein the trajectories of the air and the fuel through the injection system have been partially schematically represented.

In this regard, it is noted that the darker shaded part 52 in FIG. 5 represents the trajectory of the fuel from the injector 20 to the flame 54, whereas the lighter shaded part 82 represents the air flow.

Obviously, various modifications may be made by those skilled in the art to the invention described above without leaving the scope of the disclosure of the invention.

The invention claimed is:

1. An aircraft turbomachine comprising:

a combustion chamber including a chamber bottom perforated with openings spaced apart from one another;

an assembly associated with each opening of the chamber bottom, the assembly including an injection system for the combustion chamber and a fuel injector engaging with said injection system, the injection system comprising:

an aerodynamic bowl which is stationary with respect to the fuel injector and comprising a first widening end widening toward a downstream end thereof and centered on a central axis of the injection system, a central body along which a film of fuel is intended to flow in the downstream direction, the central body comprising a second widening end widening toward a downstream end thereof and centered on the central axis of the injection system, said first and second widening ends delimiting therebetween an air through duct, and an actuator which moves the central body relative to the injector so as to allow a relative movement between said first and second widening ends along the central axis of the injection system; and a control unit configured to control the actuator in order to vary a cross-section of the air through duct based on a speed of the aircraft turbomachine.

2. The aircraft turbomachine according to claim 1, wherein said first and second widening ends are tapered in shape.

3. The aircraft turbomachine according to claim 1, wherein the injection system comprises an intermediate structure arranged radially between a base of the central body and a base of the aerodynamic bowl, said intermediate structure defining with the base of the central body an axial duct for the flow of the film of fuel in the direction of said second widening end of the central body.

4. The aircraft turbomachine according to claim 3, wherein the base of the aerodynamic bowl comprises two concentric walls between which an air admission twist is arranged between the two concentric walls.

5. The aircraft turbomachine according to claim 1, wherein the actuator includes a motor.

6. The aircraft turbomachine according to claim 1, wherein said first widening end of the aerodynamic bowl is perforated with air admission holes in a combustion area defined by the bowl.

7. The aircraft turbomachine according to claim 1, wherein the control unit is configured to control the actuator such that the cross-section of the air through duct when the aircraft turbomachine is in an idling mode is smaller than the cross-section of the air through duct when the aircraft turbomachine is in a full-throttle mode or a cruising mode.

* * * * *